United States Patent [19]

Fayal

[11] Patent Number: 4,746,112

[45] Date of Patent: May 24, 1988

[54] EXERCISE ROWING MACHINE

[76] Inventor: James E. Fayal, 57 S. Village Green, Ipswich, Mass. 01938

[21] Appl. No.: 914,638

[22] Filed: Oct. 2, 1986

[51] Int. Cl.[4] ..... A63B 69/06

[52] U.S. Cl. ..... 272/72; 272/132

[58] Field of Search ..... 272/72, 132, 138, 140, 272/127

[56] References Cited

U.S. PATENT DOCUMENTS

| | | | |
|---|---|---|---|
| 1,974,445 | 9/1934 | Calleson . | |
| 2,183,345 | 12/1939 | Brandon | 272/72 |
| 2,725,231 | 11/1955 | Hoover . | |
| 3,558,130 | 1/1971 | Anderson . | |
| 4,249,725 | 2/1981 | Mattox . | |
| 4,396,188 | 8/1983 | Dreissigscker . | |
| 4,647,035 | 3/1987 | Yellen | 272/72 |

FOREIGN PATENT DOCUMENTS

| | | | |
|---|---|---|---|
| 1183559 | 3/1985 | Canada | 272/72 |
| 218733 | 2/1985 | German Democratic Rep. | 272/72 |
| 7706583 | 1/1979 | Sweden | 272/72 |
| 164228 | 12/1933 | Switzerland | 272/72 |

*Primary Examiner*—Alfred C. Perham
*Assistant Examiner*—Richard E. Chilcot, Jr.
*Attorney, Agent, or Firm*—Hamilton, Brook, Smith & Reynolds

[57] ABSTRACT

An exercise rowing machine is disclosed which includes a stationary seat and a rocker assembly. A handle grip coupled to a sprocket assembly drives a flywheel mounted with the rockers assembly. Fins attached to the flywheel provide braking.

24 Claims, 6 Drawing Sheets

EXERCISE ROWING MACHINE

BACKGROUND OF THE INVENTION

The present invention relates to a rowing ergometer machine which closely simulates the sensation of rowing a boat while consistently measuring the user's power and energy output. An ergometer is an energy measuring device.

In the prior art, there are a variety of rowing devices which attempt to simulate the sensations of rowing. In most cases the operator sits on a seat which slides along a rail. Rowing action is initiated by pulling on a handgrip and pushing against foot retainers located on the rail. Most of these prior art devices are extremely complicated and in general cannot be folded for conventional storage. Because these prior art devices are extremely complicated, cumbersome, and unsightly, they are generally relegated to basements and garages.

DISCLOSURE OF THE INVENTION

In accordance with the present invention, an exercise rowing machine is provided which comprises a stationary seat placed on a mat and cooperatively coupled to a rocker assembly positioned adjacent to the seat. The machine enables a rower to achieve sufficient body extension while minimizing the machine's size. A seated rower grasps a handle grip coupled to a flywheel assembly mounted on the rocker assembly. The flywheel assembly provides resistance to simulate a rowing motion. Other resistance means such as a pneumatic cylinder or electric generator may also be used in place of the flywheel assembly. Foot members with retaining straps are fixed to the rocker assembly for receiving a force from the rower which causes the rocker assembly to rock. Preferably, tie straps are provided between the seat and the mat to fix the distance of the seat to the rocker assembly as leg force is applied to the foot retainers by the rower.

The rocker assembly comprises a pair of rocker frames joined by a plurality of tie rods. The curvature of the rocker frames is such that it allows for a full extension of the rowers legs. When a flywheel assembly is used to provide the resistance for simulating rowing action it is preferred that the flywheel have fins which create uniform air drag resistance. It is further preferred that the rotation of the flywheel is monitored to indicate the user's power and energy output.

BRIEF DESCRIPTION OF THE DRAWINGS

The foregoing and other objects, features, and advantages of the invention will be apparent from the following more particular description of the preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF THE INVENTION

The present invention relates to a rowing exercise machine which closely simulates the sensation of rowing a boat while consistently measuring the user's power and energy output.

Figure 1:
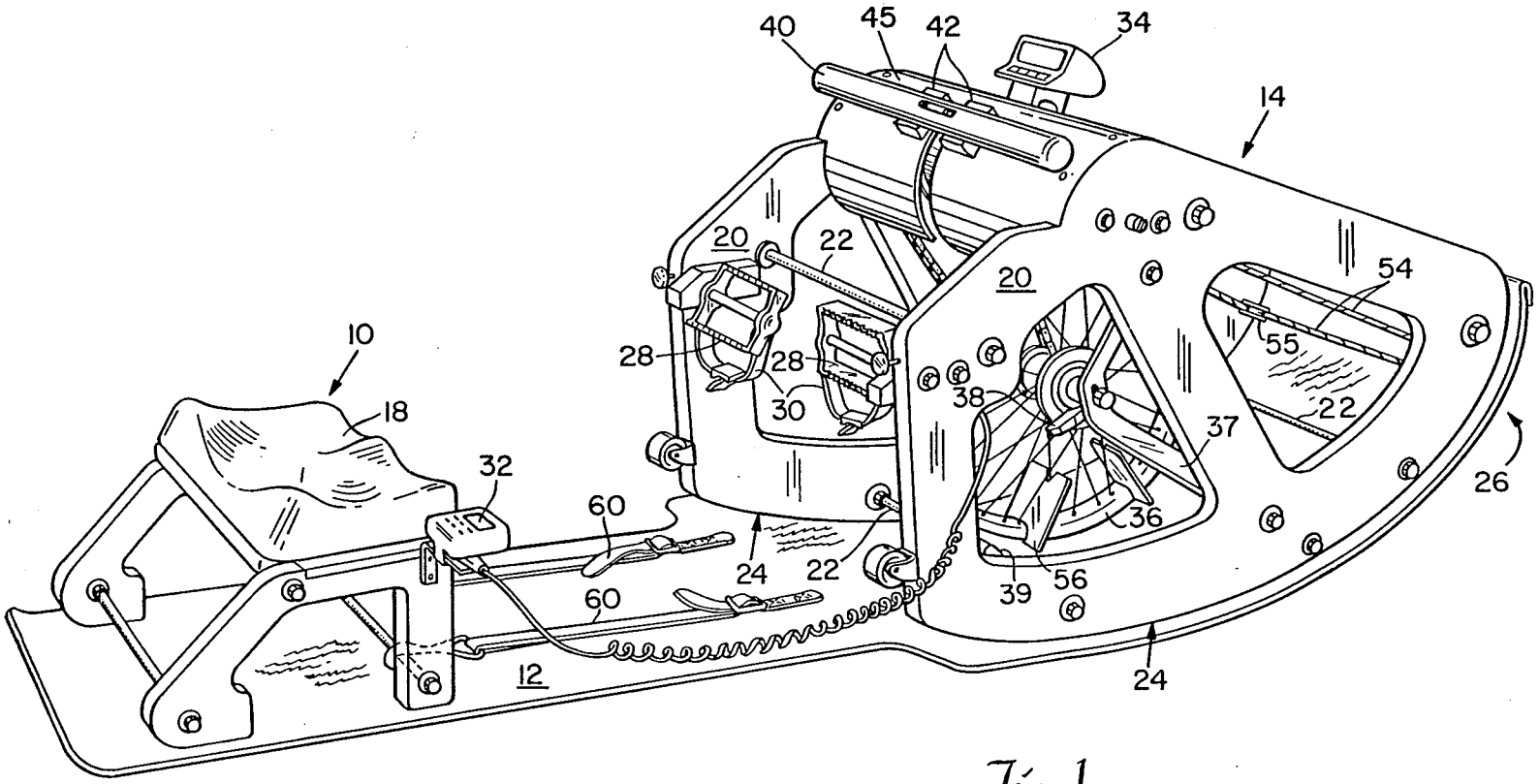
FIG. 1 is a perspective view of the exercise rowing machine.

A perspective view of the stationary rowing machine is shown in FIG. 1. As shown, a seat 10 is placed on a mat 12 which is fixed to a rocker assembly 14 at the furthest most end 26. The seat has a cushion 18 which is contoured to avoid abrasion to a rower's tailbone or cheeks during operation of the rowing machine. Preferably, the cushion is made from stiff foam rubber.

The frame of rocker assembly 14 comprises two arced rockers 20 seperated by tie rods 22. Preferably the arcs 24 of the rockers are such that the length of a full extension of a rower's legs are taken up by the arced members 24. For example, a rocker assembly which is 35.6 inches long and has a 59.75 inch radius of curvature along the arced member 24 adjacent to the seat 10 and tapers to a 24.8 inch radius of curvature toward the furthest most end 26 would accomplish this full extension for a vast majority of rowers. For an optimum curvature, the center of the latter radius of curvature should coincide with the center line of a drive shaft 44 (shown in FIG. 2).

Foot pedals 28 are attached to an inside wall of each rocker 20 of the rocker assembly to provide leverage for the rower to apply leg force to the rocker assembly 14. Preferably, the foot pedals 28 lie substantially along the same plane as the seat when the rower is in a catch position. The catch position is the point where the rower first dips his oars into the water and initiates the beginning of a power stroke. Adjustable straps 30 are provided to harness the operator's feet to the rocker assembly 14.

During operation, a seat display 32 and a console readout 34 are provided to give the operator information as to number of calories burned, speed, time measurements to go a certain distance, etc. by monitoring the revolutions of a flywheel 36 with two sensors 38 and 39. Monitoring devices capable of performing these tasks are generally available and can be mounted without great expense or effort.

In the catch position, a handle grip 40 is positioned on pads 42 which are preferably made of soft material such as foam rubber. The pads 42 are fixed on a sprocket housing 45 to allow the rower to extend from and release to the pads 42 while maintaining hand clearance.

Figure 2:
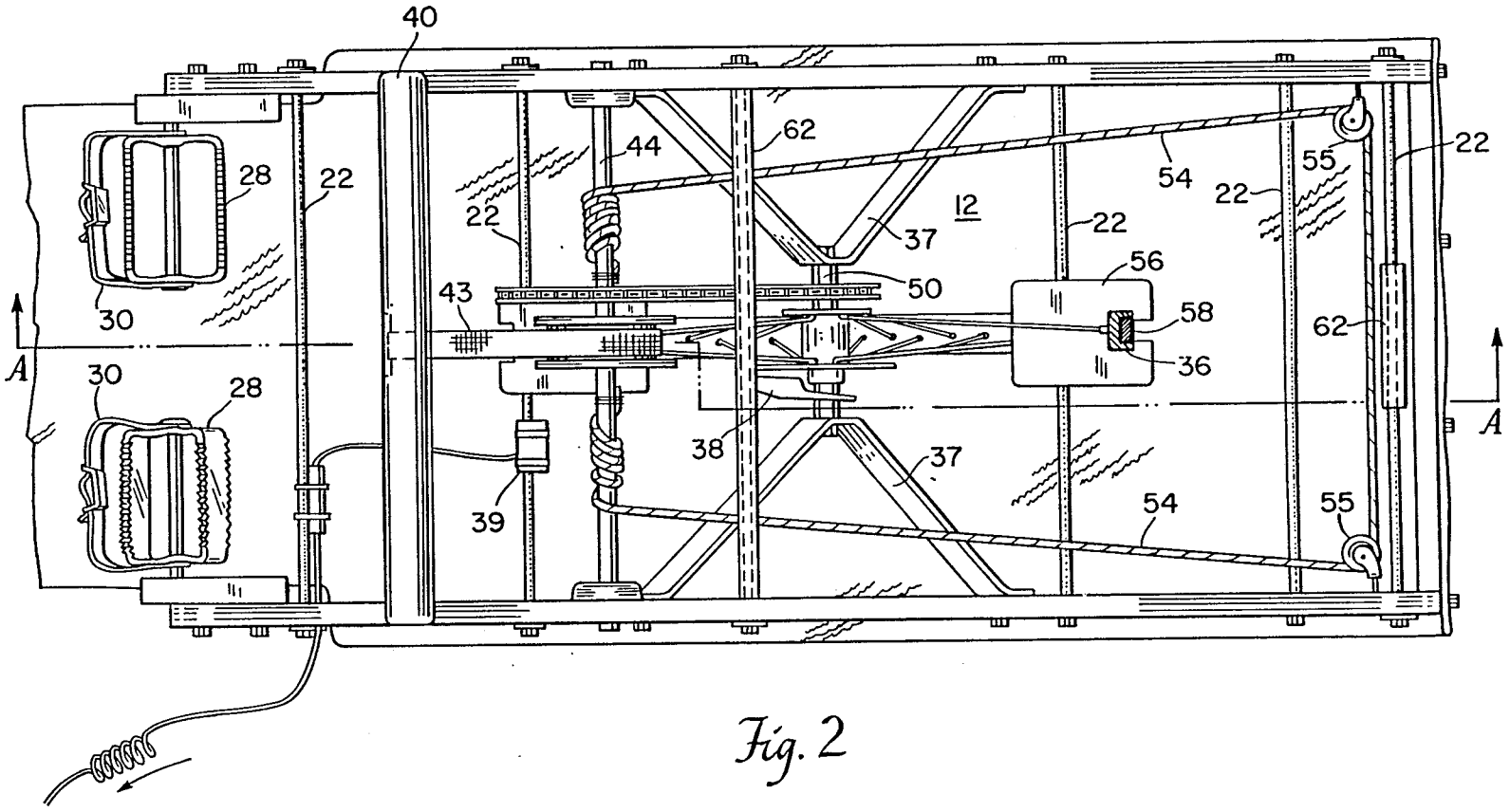
FIG. 2 is a partial top plan view of the exercise rowing machine with the housing removed.
Figure 3:
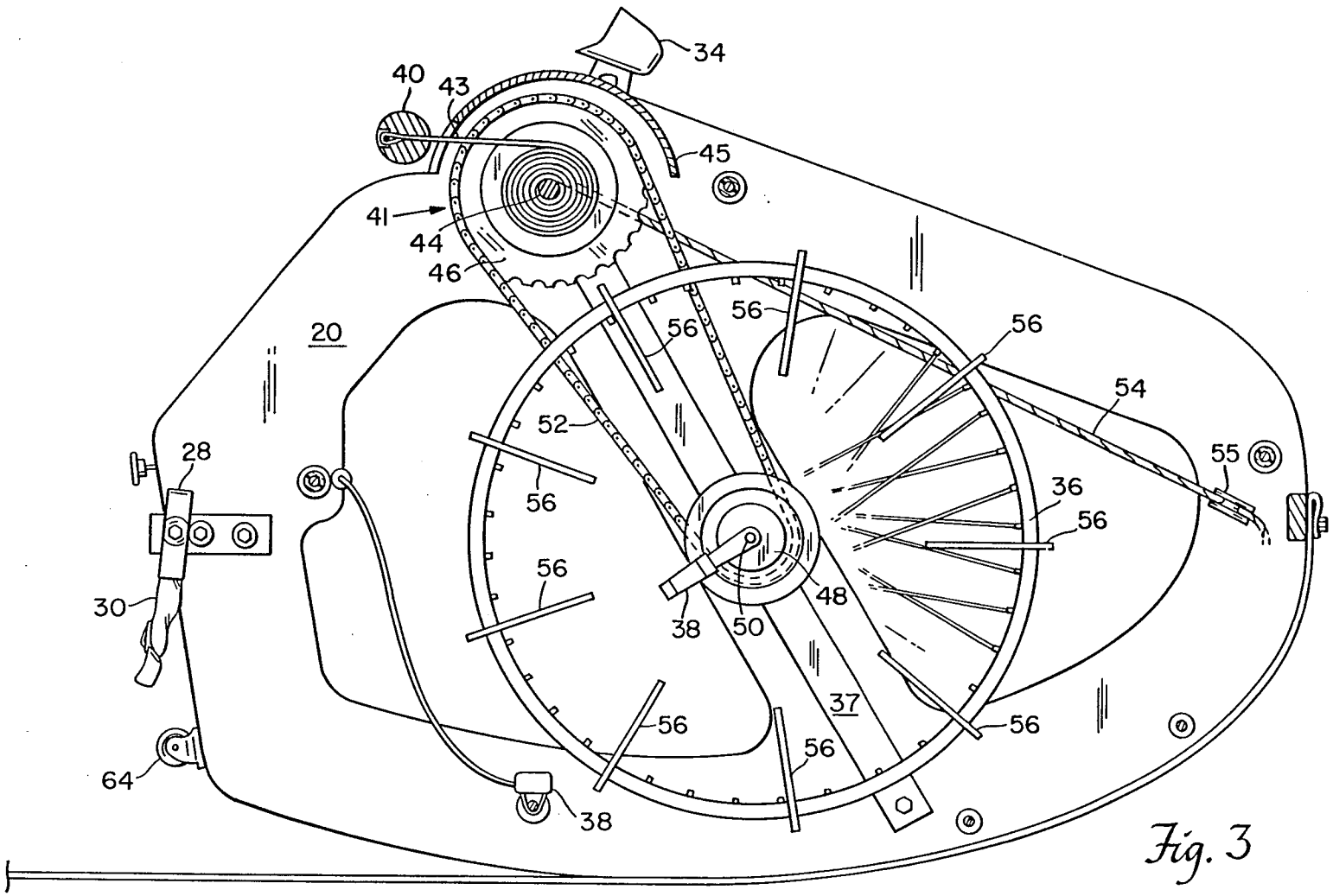
FIG. 3 is a cross sectional view of the rocking assembly of FIG. 2 taken along the line A—A.

In FIG. 2, a flywheel 36, is shown mounted between the rockers 20. Preferably, the flywheel is a balanced spoked wheel similar to a bicycle wheel. The flywheel is rotatably mounted and centered between axle mounting brackets 37 which support axle 50 of the flywheel 36. The flywheel 36 is driven by a sprocket assembly 41 (shown in FIG. 3) which is rotated by pulling the handle grip 40 in a power stroke motion or in the direction of the rower. Pulling in this direction causes a strap 43 coupled to the handle grip 40, to uncoil about a drive shaft 44. A drive sprocket 46, fixed to the drive shaft 44, rotates a sprocket 48 by a linked chain 52. The sprocket 48 houses a free wheel clutch which engages the axel 50 of the flywheel. An advantage of centering the flywheel 36 between the rocker assembly's frame is that during use of the machine gyroscopic forces help keep the machine stable. Safety is another advantage.

An elastic cord 54, suspended across two pulleys 55 and wrapped around the drive shaft 44 of the sprocket assembly 41, is used as a recoil mechanism to coil or rewind, the strap 43 about the drive shaft 44 and thus, allow the handle grip 40 to be retracted back to it static position. The recoil mechanism constructed in this manner provides for a small variation in the amount of torque being applied to the drive shaft 44 and therefore does not contribute or detract from the torque produced by the rower. This recoil mechanism also provides the additional advantage that it is compact and inexpensive to manufacture. Other recoil means, such as a recoil spring, may be used.

Fan blades 56 are located on the flywheel to dissipate energy once the flywheel 36 has been set in motion. The fan blades 56 create an air drag resistance which is exponentially proportional to the speed of the spinning flywheel 36. In other words, as the size or number of the fan blades is increased more energy is dissipated. The effect is to simulate more hull drag on a boat. Thus, the air drag of the fan blades 56 provides a mechanism for readily varying resistance to suit rowers of varying muscular strength and for simulating the drag associated with a hull of a boat. Preferably, nine fan blades 56, 3 inches by 4 inches square, are equally spaced around the radial axis of the flywheel 36 for uniform air drag. To simulate the mass of the boat and a rower sitting in it, a weighted mass 58 is placed along a rim of the flywheel 36. The mass also effects the stability of output energy readings displayed by the monitors. With mass 58 added to the flywheel 36, less rotational deceleration occurs between strokes because the rotational moment of the flywheel 36 is increased without increasing the air drag of the fan blades 56.

Figure 4:
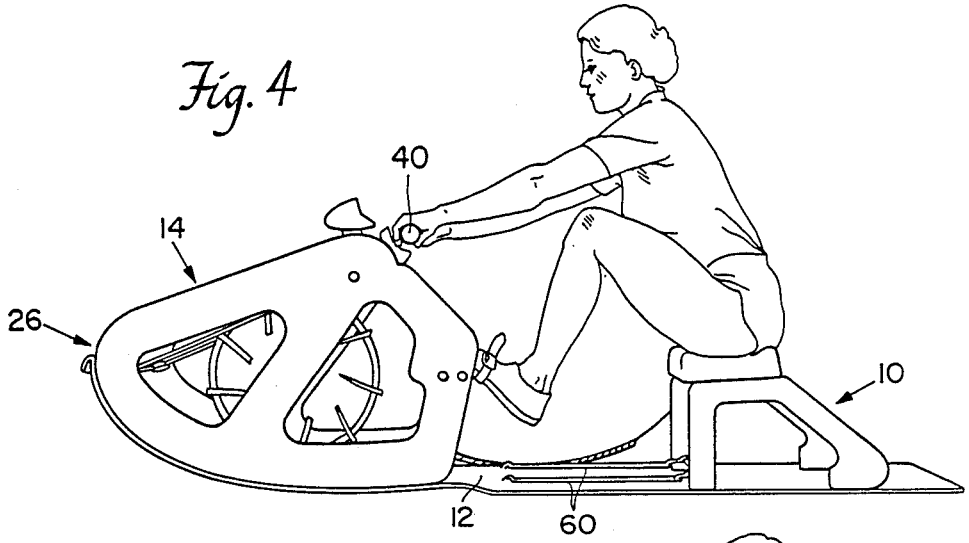
FIG. 4 is a side elevation view of a rower in the catch position using the exercise rowing machine.
Figure 5:
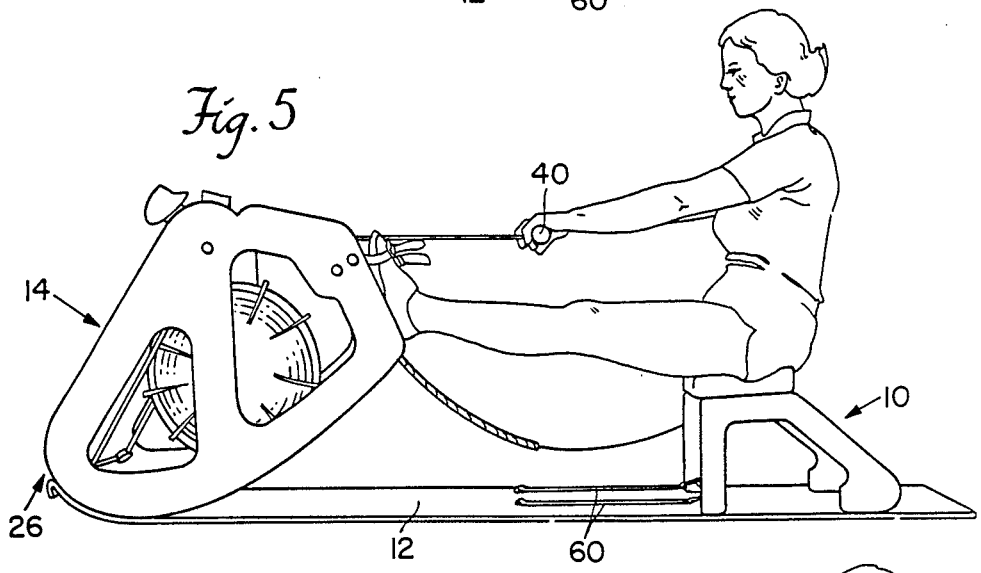
FIG. 5 is a side elevation view of the rower in FIG. 1 in a position half way through the power stroke.
Figure 6:
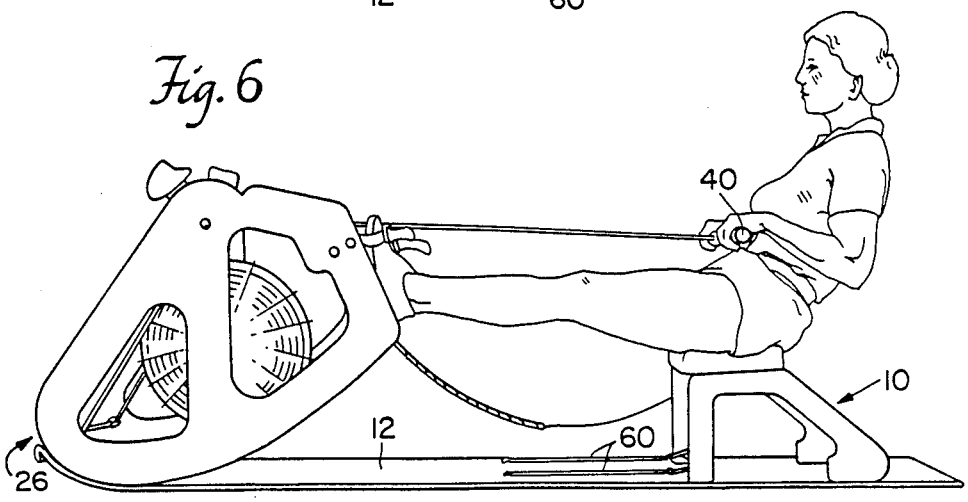
FIG. 6 is a side elevation view of the rower in FIG. 1 in a position just after the power stroke.
Figure 7:
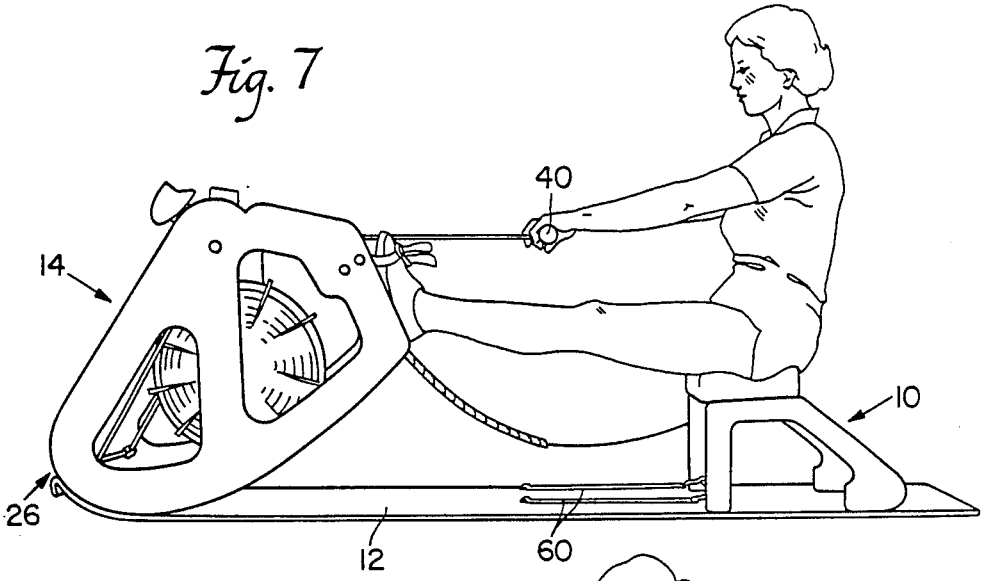
FIG. 7 is a side elevation view of the rower in FIG. 1 in a position during recovery.
Figure 8:
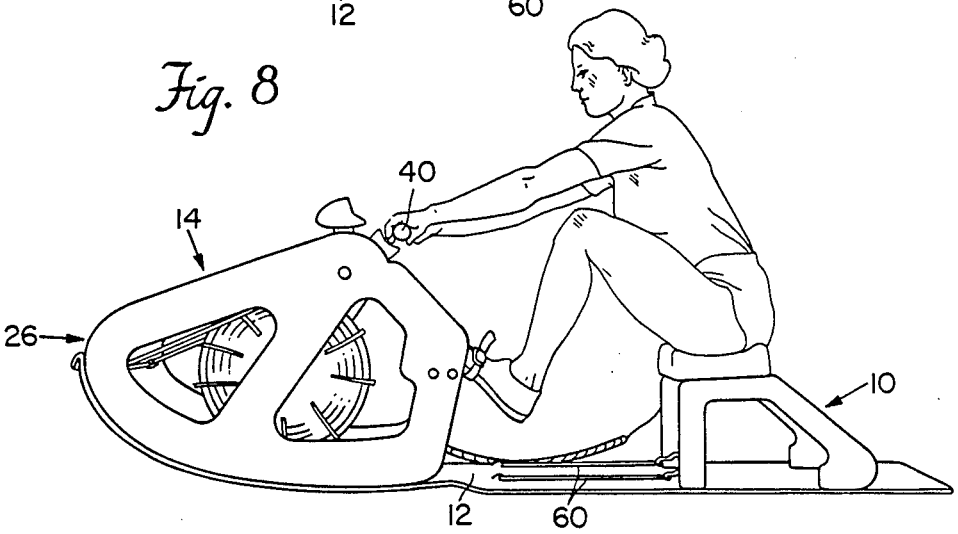
FIG. 8 is a side elevation view of the rower in FIG. 1 returning to the catch position.

During operation of the rowing machine, the rower's exercise motion is an extension and recovery rowing motion as shown in FIGS. 4–8. In FIG. 4, the rower is shown on the seat 10 in a catch position. A power stroke is initiated by extending the legs forward causing the rocker assembly 14 to tilt towards one end, as shown in FIG. 5. The relative position of the seat 10 and the rocker assembly 14 are fixed by the mat 12 which is secured to the rocker assembly 14 at the further most end 26. The mat 12 may be made of carpet or other flexible material. Preferably, adjustable tie-down straps 60 are also included for securing the seat 10 in a fix position relative to the rocker assembly 14 during operation of the machine. Alternatively, hook and pile cloth may be used in place of, or in conjunction with, the tie-down straps 60. The power stroke is completed by pulling the handle grip 40 towards the rower's chest as shown in FIG. 6. The release is the reverse motion of the power stroke and is shown in FIGS. 7 and 8.

In the present invention the extension of the rower's leg is transferred to the rockers 20 while the seat 10 remains fixed at a position which will enable the rower sufficient body extension. This results in reduced knee strain from the catch position to the power stroke position since the rocker assembly mass is accelerated rather than rowers body mass. This is in contrast to the prior art sliding seat rowing machine wherein the rower's body mass is accelerated. Similarly, knee stress is minimized when reversing the direction of motion from the power stroke position to the recovery position. Lower back stress is also reduced because, during the first half of the power stroke, the legs are raised to create a smaller angle between the back pulling force vector and the foot pushing force vector. In other words, during the latter portion of the power stroke, when the back muscles perform the bulk of the work, the angle between the leg muscles and the back muscles is reduced as compared with a similar power stroke motion of a conventional rowing machine. As a result the back muscles are more effectively utilized. This invention, therefore, allows a rower with weak knees or a weak back an opportunity to exercise back or leg muscles without aggravating his condition.

Figure 9:
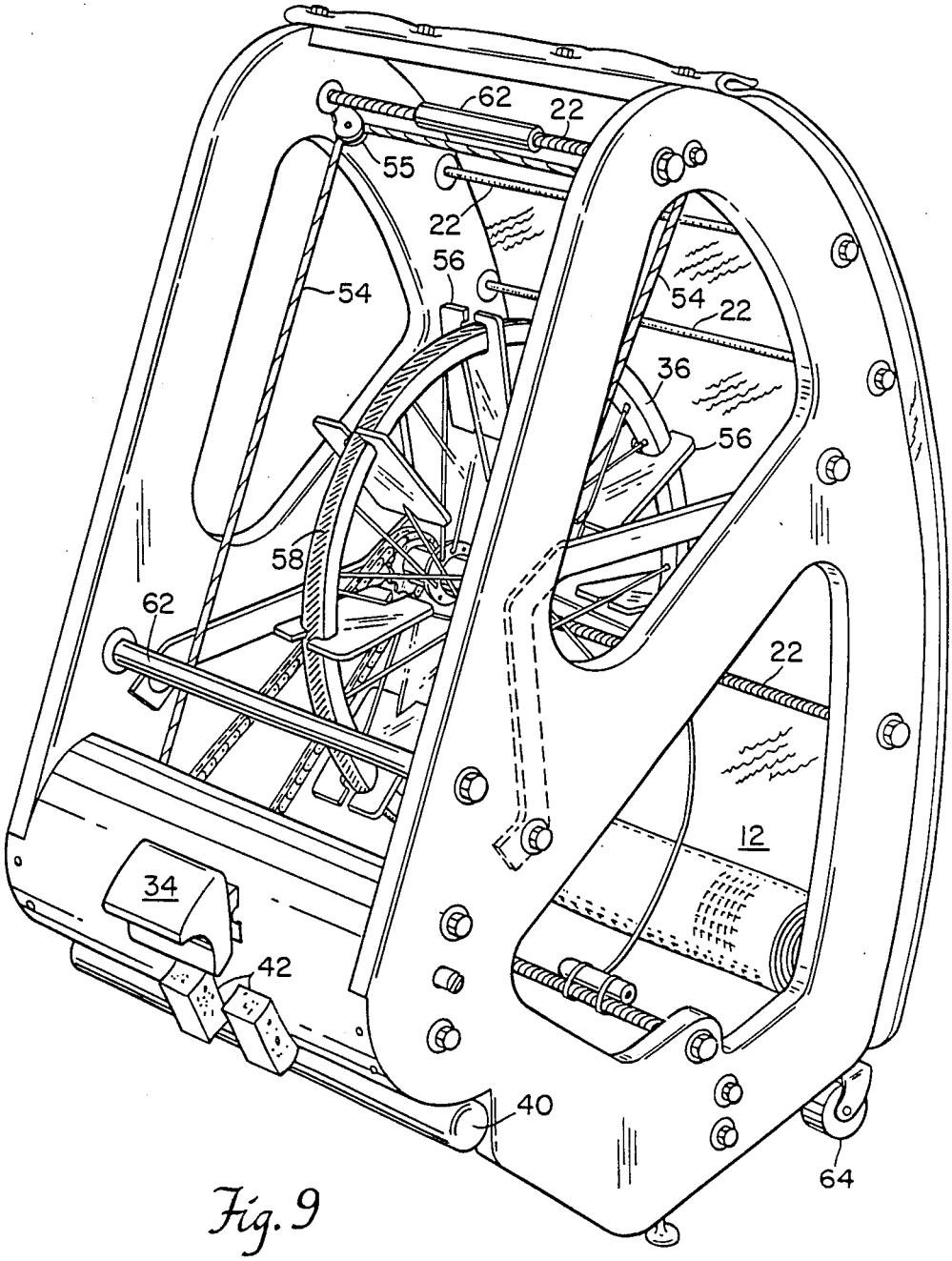
FIG. 9 is a perspective view of the exercise rowing machine in a storage position.

The exercise rowing machine in accordance with the present invention reduces the size of rowing ergometer exercise machines currently available. Further, the present invention provides a rowing machine which is easily transported and easily stored. For example, after exercise, the rowing machine can be easily disassembled by removing the seat 10 and rolling the mat 12 to fit between the rockers 20 as shown in FIG. 9. Handles 62 are located on tie-rods 22 to enable the rocker assembly 14 to be tilted on caster wheels 64 or to be picked up for placing in storage. The seat 10 may be designed to be stored within the rocker assembly 14.

Thus, the present invention contributes to correct body position throughout the stroke and recovery motion enhancing exercise efficiency and reducing the chance for injury. The present invention also enables a rower sufficient body extension while minimizing the machine's size to a compact and inexpensive machine to manufacture.

While the invention has been particularly shown and described with reference to a preferred embodiment thereof, it will be understood by those skilled in the art that various changes in form and details may be made therein without departing from the spirit and scope of the invention, as defined by the appended claims. For example, the frame may be made of any sturdy material such as wood or aluminum and may be covered by a plastic shield to house the frame. Also, other means for providing resistance such as pneumatic cylinders or electric generators or alternators may be used for providing resistance against which the rower works. A friction brake may also be used in place of the fan blades to provide braking means.

I claim:

1. An exercise rowing machine for use by a rower comprising:

a stationary seat;

a rocker assembly positioned adjacent to the seat;

coupling means for coupling the seat relative to the rocker assembly;

oar handle simulating means adapted to be grasped by the rower;

resistance means for providing resistance to the pull of the oar handle simulating means such that rowing is simulated when the oar handle simulating means is pulled by the rower; and foot members fixed to the rocker asembly aganist which the rower's leg force operates to cause the rocker assembly to rock.

2. An exercise rowing machine as claimed in claim 1 wherein said coupling means exerts a reactive force opposite to the rower's leg force.

3. An exercise rowing machine as claimed in claim 2 wherein the coupling means is a flexible mat secured to the rocker and extending beneath the seat.

4. An exercise rowing machine as claimed in claim 1 wherein the resistance means comprises a rotatable flywheel mounted within the rocker assembly.

5. An exercise rowing machine as claimed in claim 4 further comprising braking means for resisting the rotation of the flywheel.

6. An exercise rowing machine as claimed in claim 5 wherein the braking means are fan blades attached to the flywheel.

7. An exercise rowing machine comprising:

a stationary seat;

a rocker assembly positioned adjacent to the seat;

coupling means for coupling the seat relative to the rocker assembly;

a handle grip coupled to the rocker assembly;

resistance means for providing resistance to the handle grip to simulate a rowing resistance; and foot members fixed to the rocker assembly for receiving a rower's leg force to cause the rocker assembly to rock.

8. An exercise rowing machine as claimed in claim 7 wherein said coupling means exerts a reactive force opposite to the rower's leg force.

9. An exercise rowing machine as claimed in claim 8 wherein the coupling means is a mat secured to the rocker assembly and extending beneath the seat.

10. An exercise rowing machine as claimed in claim 7 wherein the resistance means comprises a rotating flywheel assembly mounted within the rocker assembly and coupled to the handle grip to provide resistance.

11. An exercise rowing machine as claimed in claim 10 further comprising breaking means for resisting the rotation of the flywheel.

12. An exercise rowing machine as claimed in claim 11 wherein the breaking means are fan blades attached to the flywheel.

13. An exercise rowing machine as claimed in claim 7 further comprising means for monitoring the rate of rotation of the flywheel.

14. An exercise rowing machine as claimed in claim 7 further comprising casters which are attached to the rocking assembly.

15. An exercise rowing machine for simulating rowing by a rower comprising:

a. a stationary seat;

b. a rocker assembly comprising a pair of parallel spaced arced frames positioned adjacent to the seat;

c. a rotatable flywheel, driven by a sprocket assembly, the flywheel being rotatably mounted between said frames;

d. a handle grip coupled to the sprocket assembly for causing the flywheel to rotate about its axis when the grip is pulled away from the rocking assembly;

e. means for recoiling the handle grip to the rocker assembly;

f. braking means for resisting the rotation of the flywheel; and g. foot members placed on the rocker assembly for receiving a rower's leg force to cause the rocker assembly to rock about the arc of the frames.

16. An exercise rowing machine as claimed in claim 15 further comprising a mat extending between the frame and the seat to secure the stationary seat in relation to the rocker assembly.

17. An exercise rowing machine as claimed in claim 15 further comprising a mass secured to the flywheel to simulate the mass of a boat and a rower sitting in the boat.

18. An exercise rowing machine as claimed in claim 15 further comprising means for monitoring and displaying the rate of rotation of the flywheel.

19. An exercise rowing machine as claimed in claim 15 wherein the breaking means are fan blades attached to the flywheel.

20. An exercise rowing machine as claimed in claim 15 wherein the stationary seat comprises foam rubber for supporting the lower back.

21. An exercise rowing machine as claimed in claim 15 further comprising casters which are attached to the rocking assembly.

22. A method of exercise comprising the steps of:

assuming a seated position on a stationary seat adjacent to a rocker assembly;

applying pressure on foot members fixed to the rocker assembly to cause the rocker assembly to rotate in a direction away from the seat from an initial position to a tilted position;

pulling a handle grip coupled to the rocker assembly away from the rocker assembly;

releasing the handle grip back to the rocker assembly; and releasing the applied pressure on the foot members to allow the tilted rocker assembly to rock back to the initial position.

23. A method of exercise as claimed in claim 22 further comprising a flexible mat extending between the rocker assembly and the seat to secure the stationery seat in relation to the rocker assembly.

24. An exercise rowing machine comprising:

a stationary seat;

a reciprocating foot attachment member for receiving a rower's leg force;

a handle grip coupled to the foot attachment member; and coupling means for coupling the foot attachment member relative to the stationary seat such that said coupling means exerts a reactive force on the attachment member opposite to that of the rower's leg force.

* * * * *